US007222657B2

(12) United States Patent
Kimura et al.

(10) Patent No.: US 7,222,657 B2
(45) Date of Patent: May 29, 2007

(54) METAL OBJECT FORMING METHOD AND MOLD USED FOR THE SAME

(75) Inventors: Koichi Kimura, Kawasaki (JP); Kota Nishii, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/338,665

(22) Filed: Jan. 9, 2003

(65) Prior Publication Data

US 2003/0230393 A1 Dec. 18, 2003

(30) Foreign Application Priority Data

Jun. 14, 2002 (JP) ..... 2002-174012

(51) Int. Cl.
*B22C 3/00* (2006.01)

(52) U.S. Cl. ..... 164/138; 164/72; 164/113; 164/418; 249/114.1; 249/115

(58) Field of Classification Search ..... 164/113, 164/138, 72, 418; 249/114.1, 115
See application file for complete search history.

(56) References Cited

U.S. PATENT DOCUMENTS 2,426,987 A * 9/1947 Dean ..... 427/134
3,075,847 A * 1/1963 Henry et al. ..... 106/38.22
3,761,047 A * 9/1973 Mao ..... 249/115
4,003,760 A * 1/1977 Labenski et al. ..... 148/265
4,976,903 A * 12/1990 Matsuhisa et al. ..... 264/86
5,384,352 A * 1/1995 Andres et al. ..... 524/404
5,439,746 A * 8/1995 Suzuki ..... 428/415
5,468,141 A * 11/1995 Iwami et al. ..... 425/542
5,855,237 A * 1/1999 Okada et al. ..... 164/113
5,874,489 A * 2/1999 D'Haenens et al. ..... 523/205
6,183,869 B1 * 2/2001 Okuda et al. ..... 428/411.1
6,224,812 B1 * 5/2001 Allan et al. ..... 264/328.1
6,460,602 B2 * 10/2002 Kubota et al. ..... 164/138

FOREIGN PATENT DOCUMENTS

JP 2001-079645 3/2001

* cited by examiner

*Primary Examiner*—Kevin Kerns
*Assistant Examiner*—Ing-Hour Lin
(74) *Attorney, Agent, or Firm*—Staas & Halsey LLP

(57) ABSTRACT

A metal object is formed by die-casting with the use of a specially treated mold. The mold has cavity-defining surfaces covered by a heat-insulating layer made of a material that includes ceramic powder and heat-resistant resin. Molten metal is injected into the cavity coated with the heat-insulating layer.

3 Claims, 2 Drawing Sheets

METAL OBJECT FORMING METHOD AND MOLD USED FOR THE SAME

BACKGROUND OF THE INVENTION

1. Field of the Invention

The present invention relates to a molding method for making metal castings such as a housing of notebook computers or other electronic devices. The present invention also relates to a die used for implementing such a method.

2. Description of the Related Art

The housing of a mobile electronic device such as a notebook computer, a cellular phone or a PDA should meet several requirements. For instance, the housing should be strong enough to carry the incorporated components safely. Also, the housing should have high thermal conductivity for effective cooling of the incorporated components. Further, to be economical with resources, the housing should be made of a material that can be easily recycled. In light of these, the housing of a recent mobile electronic device is often made of metal rather than resin.

Mobile electronic devices, such as notebook computers and PDAs, need to be small in weight and size for convenience of carriage. Producing a lightweight device needs lightweight components. In a mobile electronic device, the metal housing may often occupy more than 30% of the gross weight, and thus it is important to make the housing lightweight for achieving the total weight reduction of the mobile device. Materials suitable for making such a lightweight housing are light metals, such as magnesium (Mg) and aluminum (Al), or light alloys whose main component is one of these light materials. Among the above-mentioned light metals, magnesium is very popular for producing a metal housing because of its high specific tensile strength, effective heat-dissipating nature (which rivals Al) and low specific gravity, which is about 70% of the specific gravity of aluminum.

As known in the art, various manufacturing methods, such as die-casting and thixo molding, can be employed to form metal housings of electronic devices. By these methods, however, a problem may occur in producing a thin-walled housing. Specifically, to provide a thin-walled housing, the die cavity should be narrow accordingly. Unfavorably, the narrow space of the die cavity may impede the otherwise smooth flow of the supplied molten metal. This is because the molten metal is cooled rather rapidly as it advances in the narrow cavity, and thereby the viscosity of the molten metal becomes unacceptably high before the supplied metal can fill the every part of the die cavity.

As a material for making a metal housing of a portable electronic device, Mg alloy such as AZ91D (9 wt % of aluminum, 1 wt % of zinc 90 wt % of magnesium) is widely used. This material, however, has rather poor fluidity since it was originally developed for forming large and thick-walled parts of an automobile. Therefore, when a thin-walled housing of a portable electronic device is made of such a Mg alloy, unfilled portions often result in the obtained casting. As for notebook computers of A4 and B5 sizes, the housings are expected to have a thickness of no greater than 1.0 mm and 0.7 mm, respectively. By the conventional molding methods, it is difficult to produce such a thin-walled housing from molten Mg alloy.

JP 2001-79645A discloses a method whereby a heat insulating member is provided in the cavity-defining surface for inhibiting thermal conduction from the molten metal to the molding die so that the fluidity of the molten metal is improved. The conventional insulating member, however, needs to be designed specially for the shape of the desired casting (and hence the shape of the die cavity). Due to this, the conventional method is rather costly and makes the resultant molted product expensive.

SUMMARY OF THE INVENTION

The present invention has been proposed under the circumstances described above. It is, therefore, an object of the present invention to provide a method by which a thin-walled metal casting is properly produced. Another object of the present invention is to provide a molding die used for implementing the method.

According to a first aspect of the present invention, there is provided a method of forming a metal object. The method comprises the steps of: preparing a mold provided with a cavity-defining surface at least part of which is covered by a heat-insulating layer made of a material including ceramic powder and heat-resistant resin; and injecting molten metal into the mold.

With the above method, a thin-walled metal object can be properly formed by a die-casting technique. In accordance with the method, a part or the entirety of the cavity-defining surfaces of the mold is covered by a layer or film made of a heat-resistant resin containing a ceramic powder. Due to the inclusion of the ceramic powder (which has lower thermal conductivity than an ordinary mold made of e.g. iron alloy), the layer formed on the cavity-defining surface serves as a heat-insulating layer exhibiting low thermal conductivity. Thus, it is possible to prevent objectionable heat conduction from the injected molten metal to the mold.

Further, since the above-mentioned coating layer contains a resin component, the molten metal can flow more smoothly in the die cavity than when no such coating layer is provided, thereby allowing the metal surface of the mold to be exposed.

Still further, due to the resin component, the coating layer is resilient. Therefore, even when the mold undergoes thermal expansion upon injection of heated molten metal, the coating layer formed on the mold will not be broken. Such a durable heat-insulating layer is suitable for mass production of metal objects.

In accordance with the advantageous method of the present invention, a thin-walled metal object is produced readily and at low cost.

Preferably, the ceramic powder may be selected from a group consisting of silicon carbide powder, alumina powder and silica powder. In addition to these three substances, the group may also include zirconia powder and silicon nitride powder. The average particle diameter of the respective powder materials may preferably range from 0.1 μm to 50 μm. The silicon carbide powder, which is an abrasion-resisting material, is suitable for making the insulating layer highly durable. To attain a low production cost, it is preferable to use alumina powder, which is less expensive than the other powders.

Preferably, the heat-resistant resin may be selected from a group consisting of fluoroplastic, polybenzoimidazol resin (PBI resin), heat-resistant phenolic resin, polyimide resin, and poly(ether-ether-ketone) resin (PEEK resin). For attaining a low friction resistance, use may be made of fluoroplastic. Fluoroplastic is also advantageous since it is less expensive and can be processed more easily than PBI resin, for example. PBI resin exhibits excellent thermal resistance.

Preferably, the heat-insulating layer may contain 0.1 wt %–30 wt % of ceramic powder. Further, the heat-insulating layer may have a thickness ranging from 5 μm to 100 μm.

According to a second aspect of the present invention, there is provided a mold used for forming a metal object. The mold comprises: a cavity-defining surface; and a heat-insulating layer that covers the cavity-defining surface and that contains ceramic powder and heat-resistant resin.

Other features and advantages of the present invention will become apparent from the detailed description given below with reference to the accompanying drawings.

DETAILED DESCRIPTION OF THE PREFERRED EMBODIMENT

With reference to the accompanying drawings, the present invention will be described below based on the preferred examples (Examples 1–2) of the present invention and comparative examples (Examples 3–5).

EXAMPLE 1

<Evaluation of Flowability>

Figure 1:
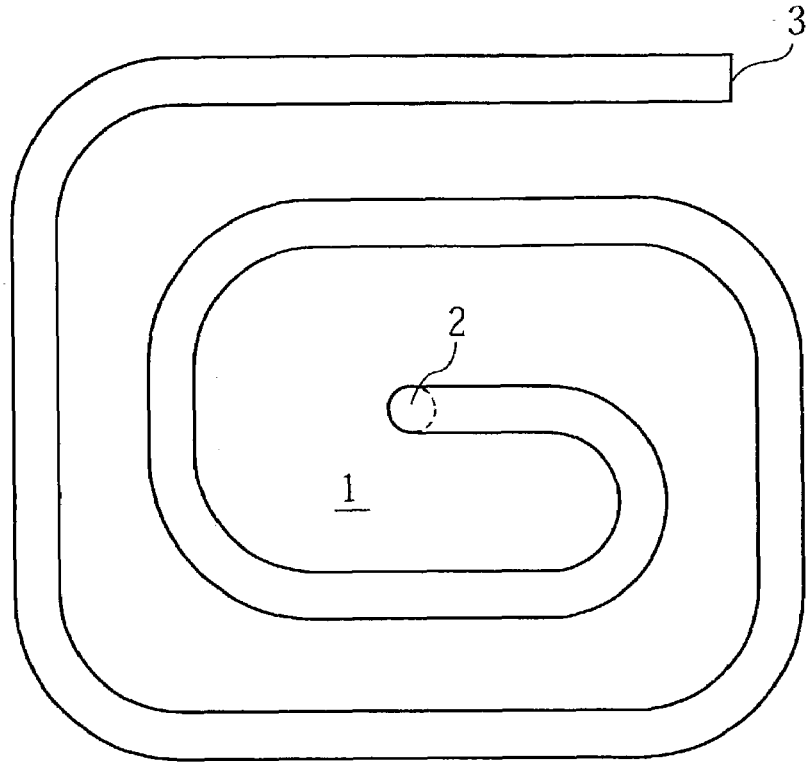
FIG. 1 is a plan view showing a cavity, or flow path, defined by a bar-flow mold used for flowability evaluation of preferred examples and comparative examples.

For the evaluation, use was made of a bar-flow mold 1 defining a spiral cavity, or flow path, as shown in FIG. 1. The flow path had a total length of 1650 mm, a width of 10 mm, and a thickness, or height, of 0.7 mm. The mold 1 had an inlet 2 and an outlet 3. The cavity-defining surfaces of the mold 1 were entirely covered by a heat-insulating layer. Into the mold 1, molten Mg alloy (AZ91D) was injected under pressure (die-casting). The evaluation of the flowability was based on the measurements of the injection pressure and flow length of the supplied metal.

The above-mentioned heat-insulating layer was made of a material containing 90 wt % fluoroplastic (Trade name Navalon by OKITSUMO Inc.) and 10 wt % alumina powder (having an average particle diameter of 0.2 μm). The layer thickness was 20 μm. The insulating layer was formed by spraying a solution of the insulating material to the cavity-defining surfaces of the mold 1 and then drying the applied material at a prescribed temperature. The molten metal was injected from the inlet 2 toward the outlet 3. The temperature of the supplied molten metal was 650° C., which is 10–30° C. higher than the liquidus temperature of the Mg alloy (AZ91D). The temperature of the mold 1 was held at 250° C. and the injection rate was 80 m/s. The results of the measurement are shown in Table 1 below.

<Forming of Sample>

Figure 3:
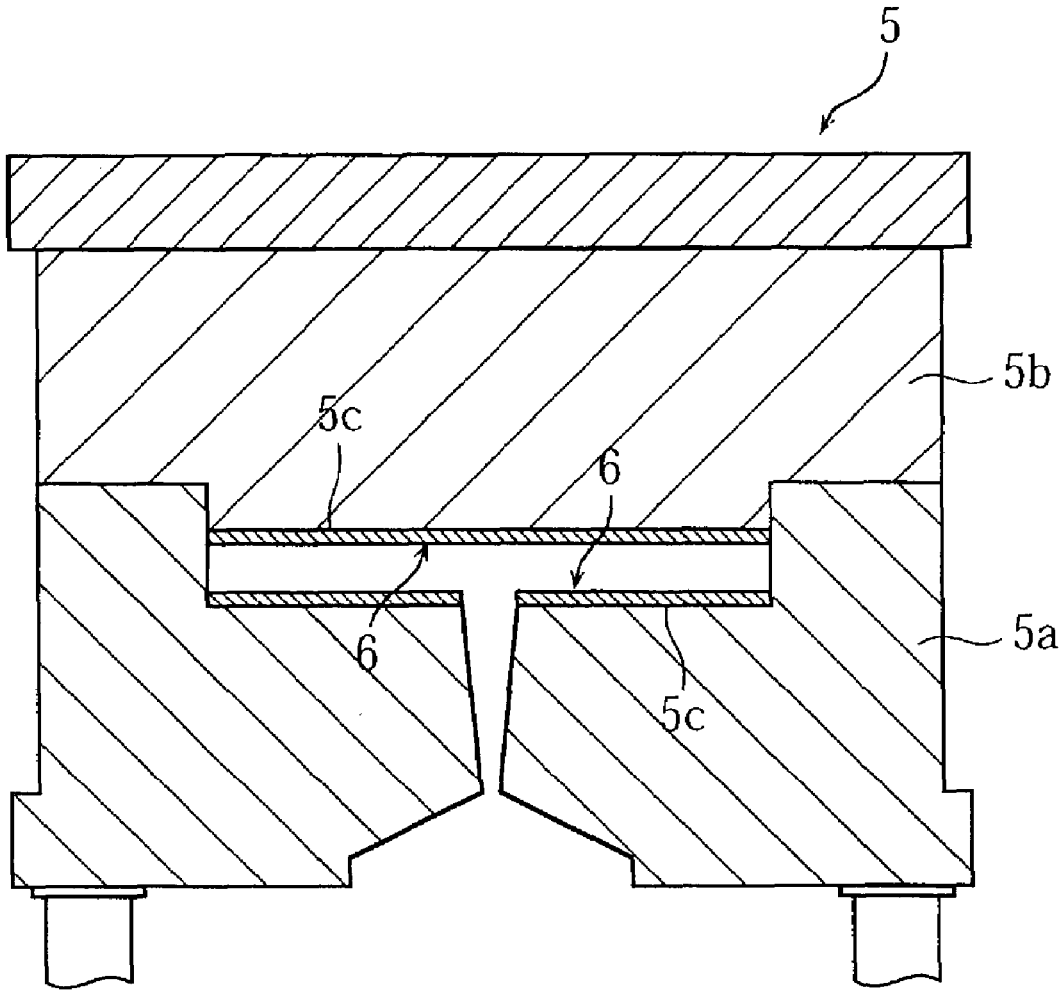
FIG. 3 is a sectional view showing a mold according to the present invention.

A sample of metal plate was formed by die-casting. Use was made of a mold which defines a prescribed cavity whose length is 150 mm, width 100 mm, and thickness 0.6 mm. The cavity-defining surfaces of the mold were entirely covered by an heat-insulating layer made of the same material as the one described above. The thickness of the layer was 20 μm. Molten Mg alloy (AZ91D) was injected into the cavity to produce the sample plate. FIG. 3 is a sectional view showing the mold 5 used. The mold 5 consists of a lower member 5*a* which is stationary and an upper member 5*b* which is movable relative to the stationary member 5*a*. The cavity-defining surface 5*c* of the mold 5 is covered by an insulating layer 6 in accordance with the present invention. The injection rate of the molten metal was chosen to be 50 m/s. Under this condition, the injection pressure of the molten metal was measured. Further, the obtained sample plate was subjected to appearance inspection for defections such as shrink marks, wrinkles, burrs, and unfilled portions void of the supplied metal. The measurements of the injection rate and injection pressure and the results of the appearance inspection are shown in Table 2 below.

EXAMPLE 2

The evaluation of flowability was carried out under the same conditions as in Example 1, except that the 20 μm-thick heat-insulating layer of Example 2 was made of a material containing 90 wt % polybenzoimidazol(PBI) resin (Trade name Polypenco by NIPPON POLYPENCO) and 10 wt % silicon carbide powder (having an average particle diameter of 0.5 μm). Also, a sample plate-was formed in the same manner as in Example 1. The insulating layer of Example 2 was prepared by submerging the cavity-defining surfaces of the mold in the solution of the heat-insulating material and then drying the coated material at a prescribed temperature. The measurements and the inspection results for Example 2 are shown in Tables 1 and 2.

EXAMPLE 3

The evaluation of flowability was carried out in the same manner as in Example 1, except that no heat-insulating layer was formed in Example 3. Further, a sample plate was formed in the same manner as in Example 1, except that the injection rate of the molten metal was chosen to be 80 m/s. The measurements and the inspection results for Example 3 are shown in Tables 1 and 2.

EXAMPLE 4

The evaluation of flowability was carried out in the same manner as in Example 1, except that the heat-insulating layer was made of TiAlN (having a thickness of 5 μm). Further, a sample plate was formed in the same manner as in Example 1, except that use was made of a TiAlN heat-insulating layer and that the injection rate of the molten metal was 80 m/s. The TiAlN layer was formed by plasma CVD utilizing $TiCl_4$, $AlCl_3$, $N_2$ as source gas. The measurements and the inspection results for Example 3 are shown in Tables 1 and 2.

EXAMPLE 5

The evaluation of flowability was carried out in the same manner as in Example 1, except that use was made of a 5 μm-thick composite heat-insulating layer consisting of a lower TiAlN layer (2 μm thick) and an upper $SiO_2$ layer (3 μm thick). Further, a sample plate was formed in the same manner as in Example 1, except that use was made of the above-mentioned composite heat-insulating layer and that the injection rate of the molten metal was 80 m/s. The TiAlN layer was formed by plasma CVD utilizing $TiCl_4$, $AlCl_3$, $N_2$ as source gas. The $SiO_2$ layer was formed by spraying heatless glass (available from OHASHI CHEMICAL INDUSTRIES LTD.) on the TiAlN layer and then drying it at 140° C. for 30 minutes. The measurements and the inspection results for Example 3 are shown in Tables 1 and 2.

TABLE 1

| | Layer Composition | Injection Pressure (MPa) | Flow Length (mm) |
|---|---|---|---|
| Example 1 | Alumina + Fluoroplastic | 9.8 | 601.2 |
| Example 2 | Silicon Carbide + PBI | 10.3 | 621 |
| Example 3 | — | 15.4 | 360.7 |
| Example 4 | TiAlN | 14.3 | 412.4 |
| Example 5 | $SiO_2$/TiAlN | 13.5 | 478.8 |

TABLE 2

| | Layer composition | Injection Rate (m/s) | Injection Pressure (MPa) | Shrinkage Wrinkle | Burr | Void |
|---|---|---|---|---|---|---|
| Example 1 | Alumina + Fluoroplastic | 50 | 5.6 | None | None | None |
| Example 2 | Silicon Carbide + PBI | 50 | 4.9 | None | None | None |
| Example 3 | — | 80 | 8.2 | Some | Some | Some |
| Example 4 | TiAlN | 80 | 7.7 | Some | Some | None |
| Example 5 | $SiO_2$/TiAlN | 80 | 5.6 | Some | Some | None |

[Analysis]

As seen from Table 1, regarding the flow length by the bar-flow mold, Example 1 and Example 2 are better than Example 3 (with no insulating layer formed on the cavity-defining surfaces) by a factor of 1.67 and 1.72, respectively. On the other hand, Example 4 and Example 5 are better than Example 3 only by a factor of 1.14 and 1.33, respectively. Regarding the injection pressure, Example 1 and Example 2 only need 64% and 67%, respectively, of the injection pressure required for Example 3, whereas Example 4 and Example 5 need no less than 93% and 88% of the injection pressure for Example 3.

The above data clearly shows that when the cavity-defining surfaces of the mold are coated with a heat-insulating layer made of a heat-resistant resin containing a ceramic powder, the flow length of molten metal can be increased and the injection pressure can be reduced than is possible with the use of a conventional TiAlN layer or $SiO_2$/TiAlN layer. This implies that the flowability of the molten metal is improved.

Figure 2:
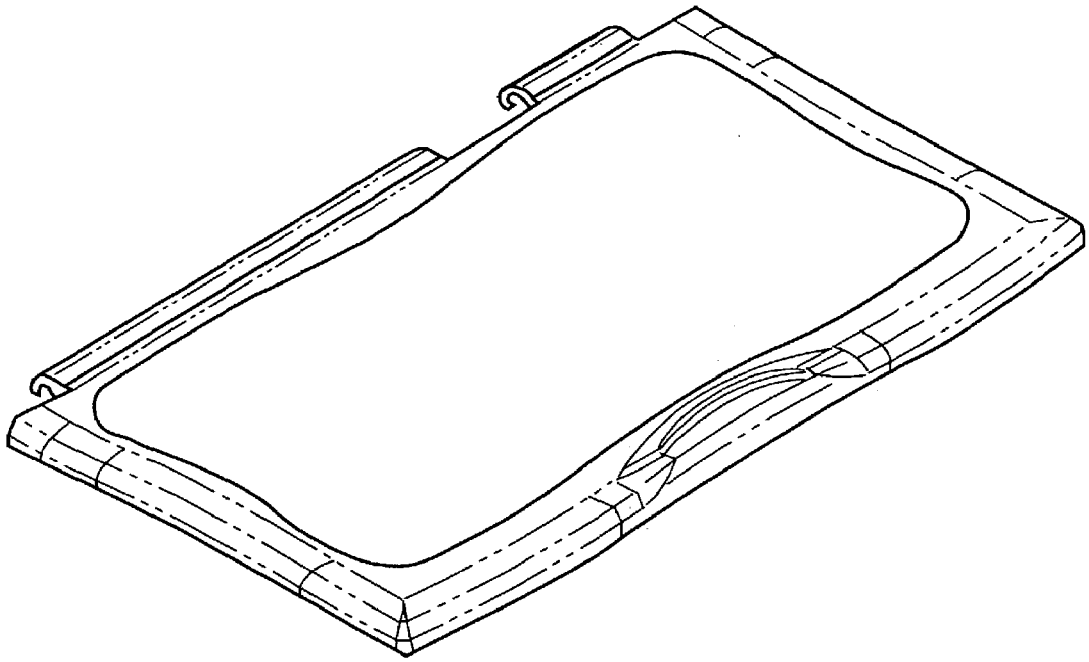
FIG. 2 shows a metal housing of a notebook computer to which the method of the present invention is applicable.

Referring now to Table 2, in the cases of Examples 1 and 2, it is possible to make 0.6 mm-thick sample plates properly (i.e., without giving rise to shrinkage, wrinkles, burrs and unfilled portions) with a lower injection rate than those of Examples 3–5. Such an advantageous casting method is applicable to the production of a notebook computer housing shown in FIG. 2.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A method of forming a metal object, the method comprising:

preparing a mold provided with a cavity-defining surface part of which is covered by a heat-insulating layer made of a heat-resistant resin-based material containing ceramic powder as a filler; and injecting molten metal into the mold, wherein the filler includes only silicon carbide powder contained in a proportion of 0.1 wt %–30 wt %;

wherein the heat-resistant resin-based material contains polybenzoimidazol resin as a base component; and wherein the molten metal is a Mg alloy.

2. The method according to claim 1, wherein the heat-insulating layer has a thickness ranging from 5 μm to 100 μm.

3. A mold used for forming a metal object made of a Mg alloy, the mold comprising:

a cavity-defining surface; and a heat-insulating layer that covers the cavity-defining surface, the heat-insulating layer being made of a heat-resistant resin-based material containing ceramic powder as a filler;

wherein the filler includes only silicon carbide powder contained in a proportion of 0.1 wt %–30 wt %; and wherein the heat-resistant resin-based material contains polybenzoimidazol resin as a base component.

* * * * *